United States Patent [19]

Ogland

[11] 4,204,674

[45] May 27, 1980

[54] POCKET-SIZE, ADJUSTABLE EXERCISER

[76] Inventor: Thomas W. Ogland, 2192 Medina Rd., Long Lake, Minn. 55356

[21] Appl. No.: 906,613

[22] Filed: May 16, 1978

[51] Int. Cl.[2] ..... A63B 21/32

[52] U.S. Cl. ..... 272/126

[58] Field of Search ..... 272/61, 67, 68, 93, 272/125, 126, 134–142

[56] References Cited

U.S. PATENT DOCUMENTS

| | | | |
|---|---|---|---|
| 1,576,474 | 3/1926 | Walker | 272/137 |
| 1,623,670 | 4/1927 | Frankenfeld | 272/68 X |
| 1,706,654 | 3/1929 | Christesen | 272/137 |
| 1,866,024 | 7/1932 | Gailey | 272/137 |
| 2,785,503 | 3/1957 | Schaefer | 272/93 X |
| 2,921,791 | 1/1960 | Berne | 272/130 X |
| 3,233,894 | 2/1966 | Binan | 272/61 |
| 3,355,171 | 11/1967 | Oesau | 272/135 X |
| 3,550,312 | 12/1970 | East | 272/67 |
| 3,740,033 | 6/1973 | Kamp | 272/125 |
| 3,966,204 | 6/1976 | Dubach | 272/135 |

FOREIGN PATENT DOCUMENTS

| | | | |
|---|---|---|---|
| 448275 | 8/1927 | Fed. Rep. of Germany | 272/136 |
| 433319 | 8/1935 | United Kingdom | 272/68 |

*Primary Examiner*—Richard J. Apley

*Attorney, Agent, or Firm*—Dorsey, Windhorst, Hannaford, Whitney & Halladay

[57] ABSTRACT

A pocket-size, adjustable exerciser used for performing tension exercises, the invention comprising a freestanding, elongated member and adjustable looped end means for gripping the exerciser. The length of the end means is selectively adjustable, depending on the exercise to be performed and on the size of the person using the exerciser.

8 Claims, 4 Drawing Figures

POCKET-SIZE, ADJUSTABLE EXERCISER

BACKGROUND OF THE INVENTION

1. Field of the Invention

The invention is an exercise device, and, more particularly, a pocket-size, adjustable exerciser used for performing tension exercises.

2. Description of the Prior Art

Devices used for exercising different parts of the body are well known. Most of these devices, however, are constructed in such a way that they can only be used in limited physical surroundings. That is, these exercisers cannot be moved because they are physically connected to a retaining surface. Many of those exercisers that can be disconnected and moved to another location cannot be relocated readily because of their large size. The exercisers that are readily transported generally are built to be attached to a retaining surface during use. The required attachment limits the use of the exerciser to a physical area having at least one solid surface and considerable space. Because of the space requirements, the user ordinarily would not be able to perform any exercises with the device while he is in an easy chair or while he is in a passenger seat of an automobile or an airplane.

SUMMARY OF THE INVENTION

The pocket-size, adjustable exerciser used for performing tension exercises includes a freestanding, elongated member and adjustable end means for gripping the exerciser. The length of the end means can be adjusted to the exercise to be performed and to the size of the person using the exerciser.

In its preferred form, the elongated member is flexible and nonelastic. A transverse groove in the middle of the member forms a hinge and transverse ribs are spaced outwardly from the groove to prevent the exerciser from slipping when it is placed in contact with the body of the person using the exerciser. Each of the transverse ribs has a face and a vertical edge; the rib face is substantially broader than the edge and slopes downwardly from the edge toward the groove disposed in the middle of the elongated member. The adjustable end means includes two looped cords, one at each end of the elongated member, a handle threaded on each cord, and three holes in each end of the elongated member through which both strands of one of the cords are threaded so that the loop of each cord is selectively adjustable in length.

The present invention minimizes or eliminates many of the problems associated with prior art exercising devices. The present invention is readily transported, and when folded can be fit into a pocket. In addition, because the device is freestanding, the person using the device does not need a retaining surface or a substantial amount of space. The exerciser of the present invention is fully effective even when used in an easy chair or a passenger seat of an automobile or airplane.

BRIEF DESCRIPTION OF THE DRAWINGS

In the drawings which form a part of this application, and in which like numerals refer to like parts.

DESCRIPTION OF THE PREFERRED EMBODIMENT

Figure 1:
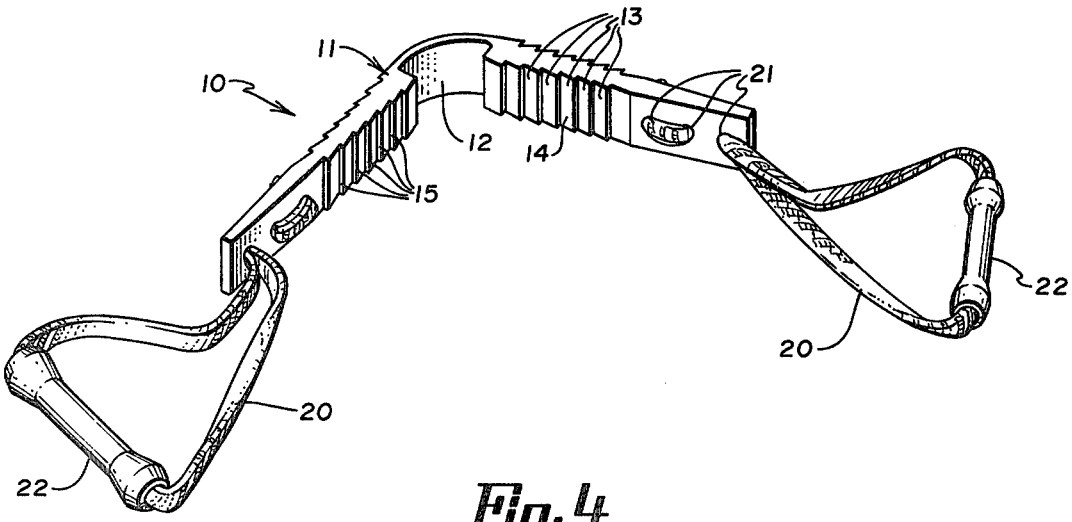
FIG. 1 is a perspective view of the pocket-size, adjustable exerciser.

FIGS. 1 through 4 of the drawings illustrate a pocket-size, portable exerciser 10 made in accordance with and embodying the principles of the present invention. The exerciser 10 includes a free-standing, elongated member 11 and adjustable end means preferably comprising looped ropes or cords 20, and holes 21, which are drilled in each end of the elongated member 11, and the handles 22, which are threaded on the ropes or cords 20.

Figure 2:
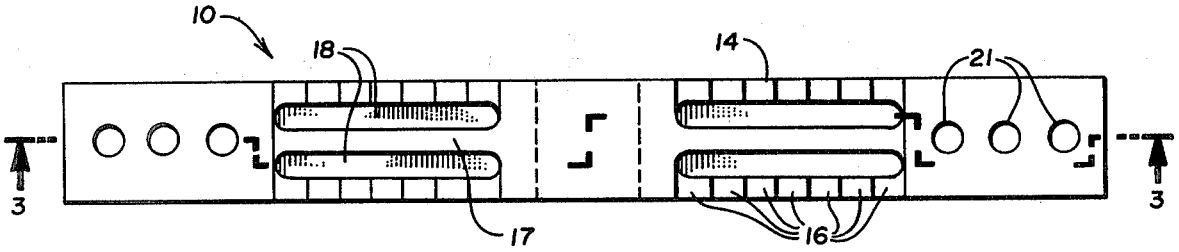
FIG. 2 is a plan view of the lower surface of the exerciser.
Figure 3:
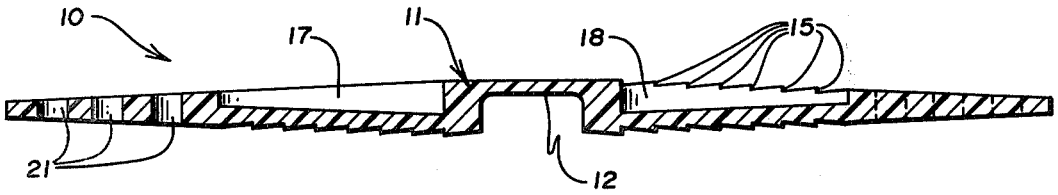
FIG. 3 is a sectional view of the exerciser taken along line 3—3 of FIG. 2.

The elongated member 11 is preferably formed from a nonelastic, flexible material such as polypropylene. The member 11 may be injection-molded to ensure its structural integrity during use. Positioned in the center of the elongated member 11 is the transverse groove 12, which allows the member 11 to hinge or flex freely. The upper surface, in which the groove 12 is disposed, and the lower surface of each end of the elongated member 11 are formed with transverse ribs 13 and 16, respectively. As seen in FIGS. 2 and 3, the ribs 16 on the lower surface of the elongated member 11 are interrupted by the longitudinally-extending ribs 17 and the recesses 18 extending on both sides of the ribs 17. The purpose of the ribs 17 is to enhance the strength of the member 11. As seen in FIGS. 1 and 2, each of the transverse ribs 13 and 16 has a face 14 and a vertical edge 15; the rib face 14 is substantially broader than the edge 15 and slopes downwardly from the edge 15 toward the groove 12. The ribs 13 and 16 prevent the exerciser 10 from slipping when it is placed in contact with the body of the person using the exerciser 10.

The looped length of the cords 20 is adjustable to the exercise to be performed and to the size of the person using the exerciser 10. Preferably, both strands of the cord 20 on each end of the elongated member 11 are threaded through the three holes 21 on each end of the member 11, beginning with the hole 21 furthest from the groove 12. Each strand is threaded through the outermost hole 21 from the upper surface of the member 11 and then back through the middle hole 21 and finally through the innermost hole 21. Once both ends of the cord 20 have been threaded through all three holes 21, the ends are tied together in a knot. The handles 22 are slid onto the cord 20 before it is threaded through the holes 21.

The length of the loop of cord 20 on each end of the member 11 is selectively adjustable in length. The loop formed by the cord 20 can be reduced by threading more of the cord 20 through the three holes 21. Conversely, the loop can be lengthened by pulling the cord 20 through the holes 21, beginning with the innermost hole 21. Pulling outwardly on the cord handles 22 while exercising will not loosen the cord 20 because of the friction existing between the holes 21 and that portion of the cord 20 threaded through the holes.

Figure 4:
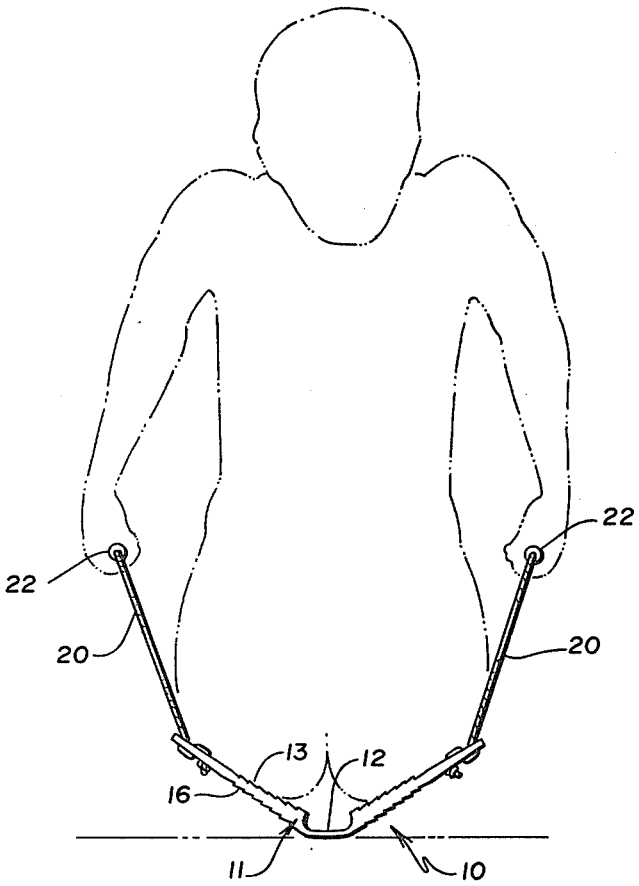
FIG. 4 shows one of the ways in which exercises can be performed with the present invention while the person using the exerciser is in a seated position.

The pocket-size, adjustable exerciser 10 can be used to perform a variety of tension exercises, including arm curls, arm raises, arm spreads, leg raises and leg spreads. FIG. 4 depicts one way in which the exerciser 10 can be used while the person using the exerciser is in a seated position. Because the exerciser 10 does not occupy additional space, it can be used in an easy chair or during travel, such as when the user is in a passenger seat of an automobile or an airplane.

To perform additional exercises, the exerciser 10 can employ more than one looped length of cord or rope 20 on either or both ends of the elongated member 11. For example, one end of the member 11 can be anchored to the user's feet with two looped lengths of cord 20 while the user pulls the cord(s) extending from the other end--with one hand if one looped length of cord 20 is used, or with both hands if two cords 20 are used.

Although the preferred embodiment has been described in detail, it is contemplated that various modifications could be made to the structure of the preferred embodiment by those skilled in the art without deviating from the spirit or scope of the present invention. For example, the exerciser 10 could be made out of a material other than polypropylene. In addition, instead of a single groove 12, multiple grooves could be used to effect the flexibility of the exerciser. It is also envisioned that the exerciser could employ other end means for gripping the exerciser 10 and a different number of holes or configuration of holes. Accordingly, the scope of the present invention should not be dictated by the description of the preferred embodiment.

I claim:

1. A pocket-size, adjustable exerciser for performing tension exercises, which comprises:

a freestanding, elongated member hinged along a transverse groove in the middle thereof;

rope-like material mounted to each end of the elongated member for gripping the exerciser; and means for adjusting the length of the rope-like material to the exercise to be performed and to the size of the person using the exerciser.

2. The exerciser of claim 1, wherein the elongated member has transverse ribs spaced outwardly from the groove to prevent the exerciser from slipping when it is placed in contact with the body of the person using the exerciser.

3. The exerciser of claim 2, wherein each of the ribs has a face and a vertical edge, the face being substantially broader than the edge and sloping downwardly from the edge toward the groove.

4. The exerciser of claim 3, wherein the means for adjusting the length of the rope-like material comprises:

looped rope-like material, one at each end of the elongated member; p1 a handle attached to each rope-like material; and three holes in each end of the elongated member through which both strands of one of the looped rope-like materials are threaded so that the loop of each rope-like material is selectively adjustable in length.

5. The exerciser of claim 1, wherein the elongated member is made of polypropylene.

6. The exerciser of claim 1, wherein the means for adjusting the length of the rope-like material comprises:

a plurality of holes in the ends of the elongated member through which the rope-like material is threaded so that the rope-like material is selectively adjustable in length.

7. The exerciser of claim 6, wherein both strands of the cord are threaded through the holes.

8. The exerciser of claim 7, wherein the cord has a handle attached thereto.

* * * * *